US005267367A

United States Patent [19]

Wegmann, Jr.

[11] Patent Number: 5,267,367

[45] Date of Patent: Dec. 7, 1993

[54] SAFETY RAMP AND METHOD FOR PROTECTING HOSES AND CONDUITS

[76] Inventor: Gerald A. Wegmann, Jr., Box 3386, Texas City, Tex. 77592-3386

[21] Appl. No.: 819,883

[22] Filed: Jan. 13, 1992

[51] Int. Cl.[5] ..... E01D 1/00; E01C 11/22

[52] U.S. Cl. ..... 14/69.5; 404/3; 52/220.5

[58] Field of Search ..... 404/1, 3-4, 404/34-35; 14/2.4, 69.5, 71.1; 52/221

[56] References Cited

U.S. PATENT DOCUMENTS

| | | | |
|---|---|---|---|
| 355,330 | 1/1887 | Locke | 404/3 |
| 506,018 | 10/1893 | Sampson | 404/3 |
| 687,106 | 11/1901 | Anderson | 404/3 |
| 777,524 | 12/1904 | Lockwood | 404/3 |
| 1,873,815 | 8/1932 | Brouner | 52/221 |
| 2,594,425 | 4/1952 | Greenberg | 52/273 |
| 2,984,417 | 5/1961 | Voorhees | 14/69.5 |
| 3,503,425 | 3/1970 | Holm | 404/3 X |
| 3,912,408 | 10/1975 | Domnick | 404/35 |
| 4,124,324 | 11/1978 | Augis et al. | 404/3 |
| 4,145,152 | 3/1979 | Waugh | 404/71 |
| 4,258,515 | 3/1981 | Owen | 52/105 |
| 4,612,746 | 9/1986 | Higgins | 52/221 |
| 4,697,294 | 10/1987 | Schäfer | 404/35 |
| 4,953,249 | 9/1990 | Warwick | 404/1 |

*Primary Examiner*—Ramon S. Britts
*Assistant Examiner*—Nancy P. Connolly
*Attorney, Agent, or Firm*—Vaden, Eickenroht, Thompson, Boulware and Feather

[57] ABSTRACT

An apparatus and method have been developed for protecting a hose or other utility conduit from damage caused by traffic crossing over such conduits. Substantially rectangular ramp units with covered conduit channels are interlocked to form an elongate safety ramp with a channel running the length of the ramp for receiving a conduit. The ramp units are interlocked to form a linear or branched safety ramp.

19 Claims, 3 Drawing Sheets

SAFETY RAMP AND METHOD FOR PROTECTING HOSES AND CONDUITS

BACKGROUND OF THE INVENTION

The present invention relates to an apparatus and method for protecting a hose or other utility conduit from damage caused by traffic crossing over such conduits. Substantially rectangular ramp units with covered conduit channels are interlocked to form an elongate ramp with a channel for receiving a conduit. The ramp units can be interlocked in a linear chain or in a branched pattern.

Flexible hoses and other utility conduits have many uses in industry, particularly in oil refineries and chemical manufacturing installations. Such conduits, for instance, may be pressurized with air, nitrogen, water, other fluids, steam, or hazardous materials, may conduct electricity, water, or may include cable for conducting signals from remote sensor locations. Frequently in the course of construction and maintenance of such installations, such conduits must be run across roads or other areas exposed to vehicular traffic. A protection device for the conduits is therefore needed to prevent traffic from damaging such conduits and to avoid safety hazards.

The common industry practice for protecting conduits on roads or other traffic areas is to lay sheets of plywood over boards or build a ramp out of such materials. Such designs provide marginal protection for the conduit, are not particularly durable, and are unstable when, for instance, they must be crossed by a truck with a gross vehicle weight of 80,000 or more pounds. Construction from plywood and boards is also time consuming and costly.

Various other conduit coverings are known in the art, but are directed to concealing and covering conduits in buildings primarily on walls and floors. Such coverings, in the case of electrical wireways and pipes, often are merely for decorative purposes. Others have the purpose of protecting conduits from spilled fluids and dust particles and from being kicked or shoved loose inadvertently. While these coverings provide some protection to conduits, none of them are weight bearing to such a degree as to make them suitable for the weight of vehicular traffic such as that described above. Further, these coverings are not designed for easy assembly and removal.

It is, therefore, a principle object of the present invention to provide a method and apparatus which overcomes these disadvantages and limitations of the prior art by providing safe, durable, and stable protection for such conduits.

It is also an object of the present invention to provide an apparatus, in the form of a safety ramp, which is "modular" in the sense that it can easily be extended, by interlocking each safety ramp in end-to-end fashion, to form a long chain of safety ramps for protecting the entire length of the conduit.

It is also an object of the present invention to provide a safety ramp that protects conduits from vehicular traffic which is easily assembled and dismantled.

It is also an object of the present invention to provide a safety ramp comprised of materials that are relatively impervious to exposure to ambient weather conditions and which are resilient enough to withstand impact and the insult of heavy loads.

Other objects, and the advantages, of the present invention will be made clear to those skilled in the art by the following description of a presently preferred embodiment thereof.

SUMMARY OF THE INVENTION

The objects of the invention are met by use of the safety ramp and the method for protecting hoses and conduits described herein. A plurality of substantially rectangular ramp units, having opposed ramp plates, and covered conduit channels running their length, are interlocked to form a chain of ramp units. These chains of ramp units protect a length of hose or other utility conduit. The ramp units are interlocking and readily assembled and dismantled because they are provided with, in the preferred embodiment, projecting members on one interlocking end and openings in the other interlocking end for receipt of the projecting members. Alternative embodiments include ramp units having additional interlocking ends so that the units can be connected in branched patterns.

The method of the present invention involves interlocking a plurality of the ramp units by inserting the projecting member of one ramp unit into an opening formed in the next ramp unit. The hose or other utility conduit is then placed into the conduit channel formed throughout the length of the chain of ramp units and a cover is used to close each conduit channel. The top surface of each cover is substantially flush with the maximum height of the ramp unit.

DETAILED DESCRIPTION OF THE PREFERRED EMBODIMENT

Figure 1:
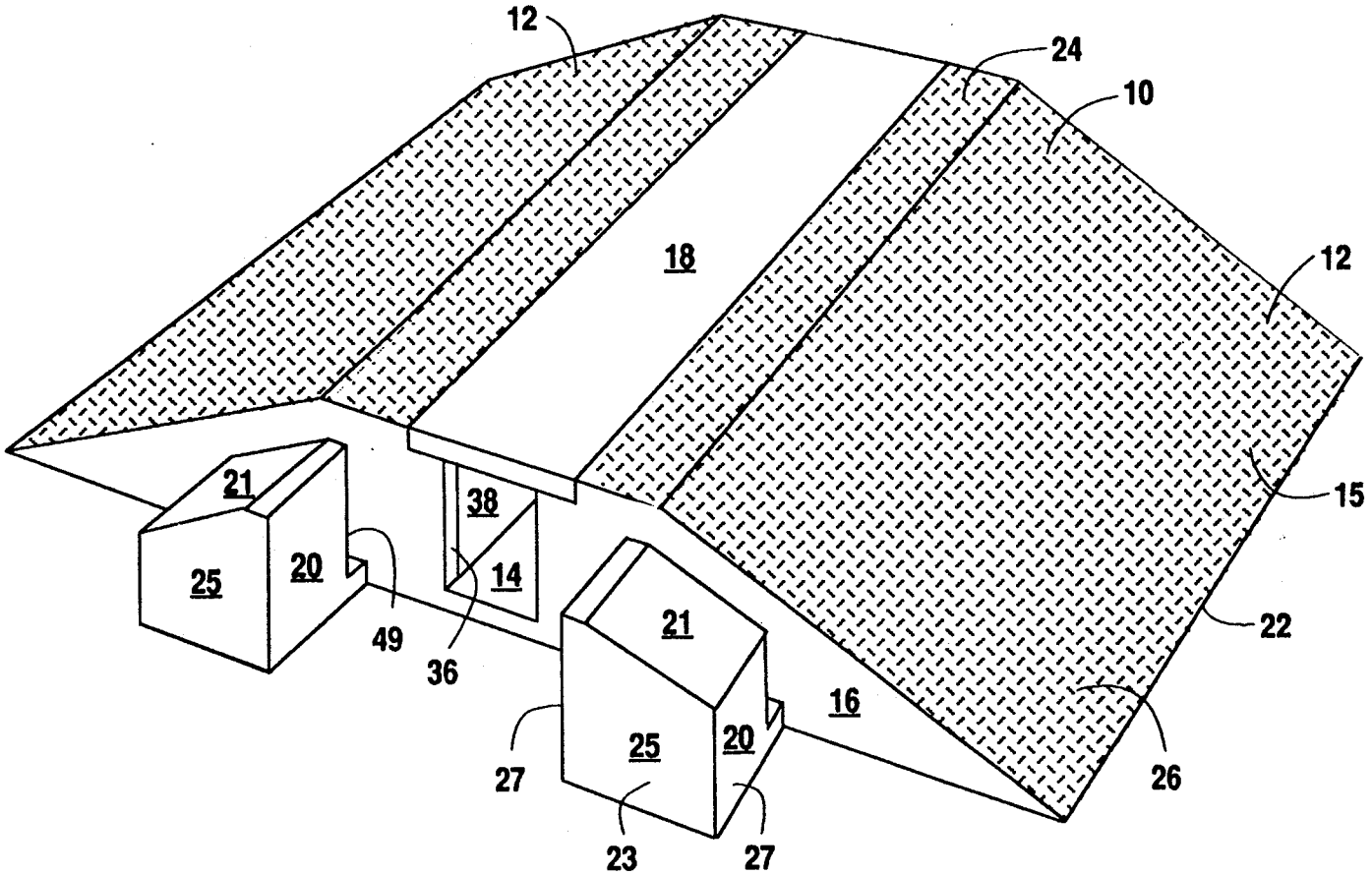
FIG. 1 shows a perspective view of a preferred embodiment of a safety ramp unit of the present invention.

The safety ramp of the present invention is comprised of a plurality of ramp units, indicated generally at reference numeral 10 in FIG. 1. Each ramp unit 10 is generally rectangular in shape when viewed from above with two opposing ramp plates 12 which form the sides 15 of the top surface of the unit 10. The ramp plates 12 incline from the outer edge 22 of the ramp unit 10 toward a central conduit channel 14 formed in the ramp unit 10. The ramp plates 12 reach a maximum height and thereafter form a substantially horizontal plane 24 on each side of the conduit channel 14. The conduit channel 14 runs the length of the ramp unit 10, e.g., from one end 16 to the other end 16.

Figure 2:
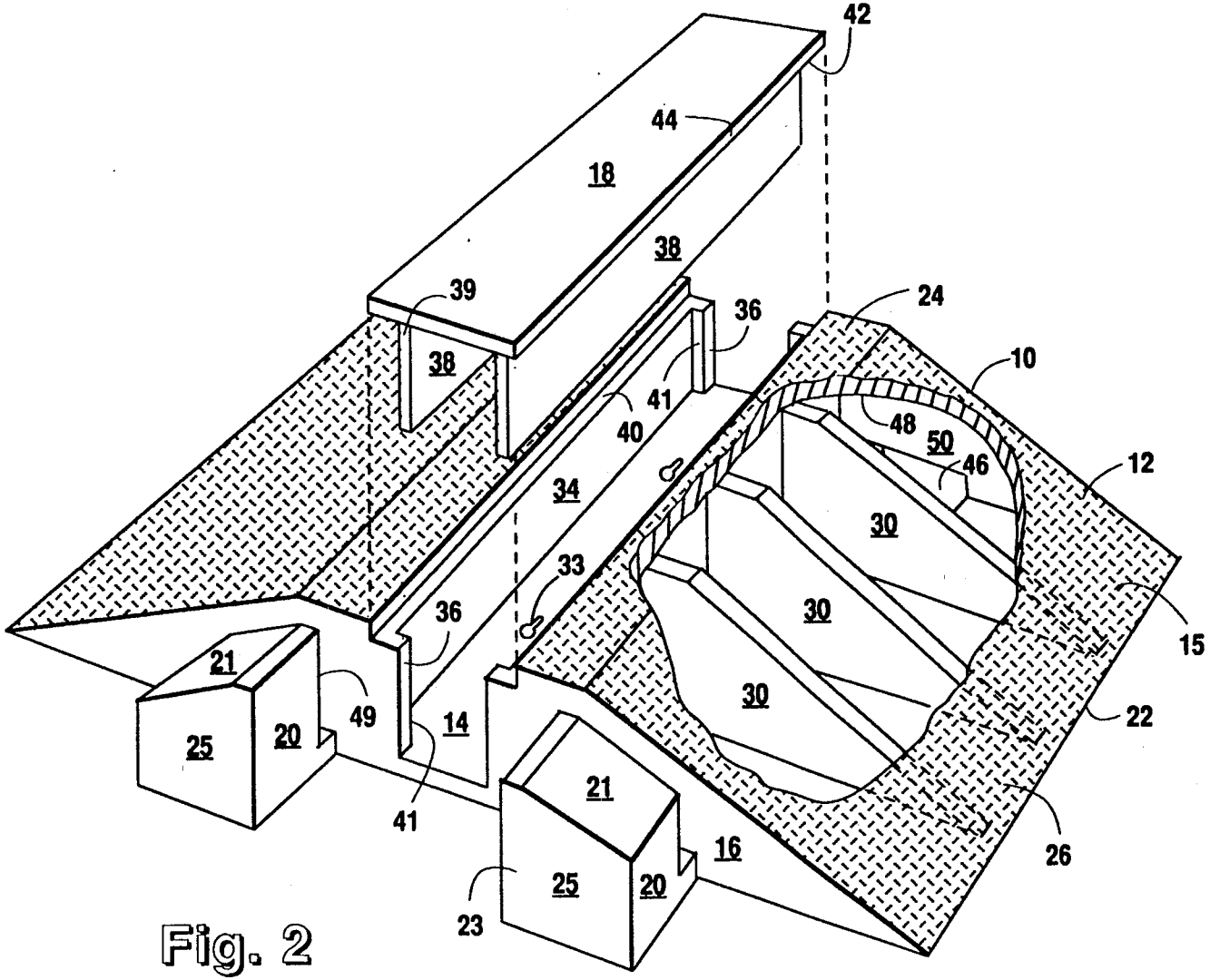
FIG. 2 is a perspective view of the ramp unit of FIG. 1 having the channel cover removed therefrom and a portion of the ramp plate cut-away to show the internal structure of the ramp unit.

The ramp unit 10 is provided with a channel cover 18 that fits into the conduit channel 14 to provide a protective covering for a hose or other utility conduit (not shown) positioned in the conduit channel 14. The channel cover 18 is provided with means, in the form of the legs 38 extending downwardly therefrom and spaced apart so as to approximate the shape of the conduit channel 14 and frictionally engage the side walls 34 of conduit channel 14, as best shown in FIG. 2, for preventing relative movement between cover 18 and ramp unit 10. This resistance, in the preferred embodiment, is also provided by the vertical dimension of the legs 38, which extend downwardly from the channel cover 18 to rest on the bottom 32 of the conduit channel 14 to support the channel cover 18.

To provide additional support and to help prevent relative movement between cover 14 and ramp unit 10, the legs 38 are formed inwardly from the edges 44 of the channel cover 18 to form flanges 42 running the length of the edges 44 of the channel cover 18. When channel cover 18 covers the conduit channel 14, the flanges 42 of the channel cover 18 rest on shelves 40 formed in the walls 34 of the conduit channel 14. For additional support, and to prevent longitudinal movement between said cover 18 and the ramp unit 10, the conduit channel 14 of each ramp unit 10 is provided with corner posts 36 formed in the walls 34 of the conduit channel near the ends 16 thereof. The channel cover 18 rests on these four corner posts 36 and the ends 39 of legs 38 abut the inside surfaces 41 of corner posts 36.

Adjacent ramp units 10 are interlocked to form a chain of ramp units by members 20 that project outwardly and upwardly from the end 16 of each ramp unit 10. These projecting members 20 are adapted to be received through openings 46 formed in the other end 16 of an adjacent ramp unit 10. When a projecting member 20 is received through the opening 46 of an adjacent ramp unit 10, the retaining surface 49 of member 20 engages the inside surface 50 of the end 16 of the adjacent ramp unit to interlock the two ramp units as shown in FIG. 4.

Figure 4:
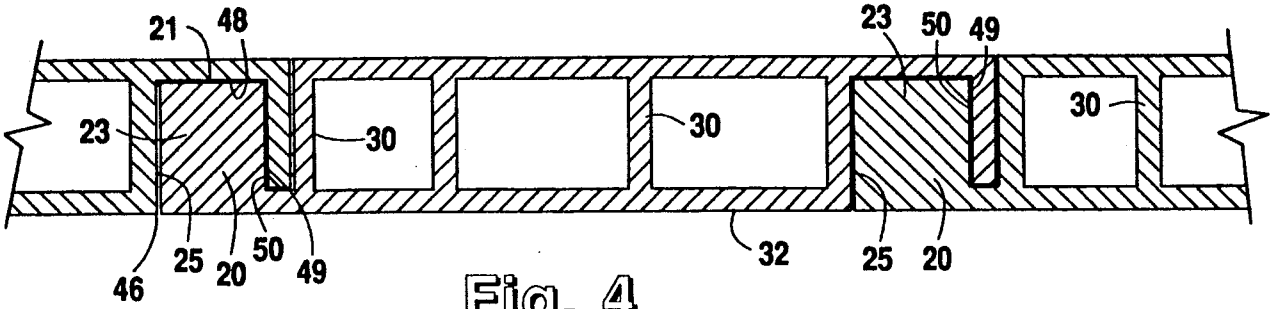
FIG. 4 is a longitudinal sectional view of three of the ramp units of FIG. 1 interlocked with each other to form a chain of ramp units.
Figure 3:
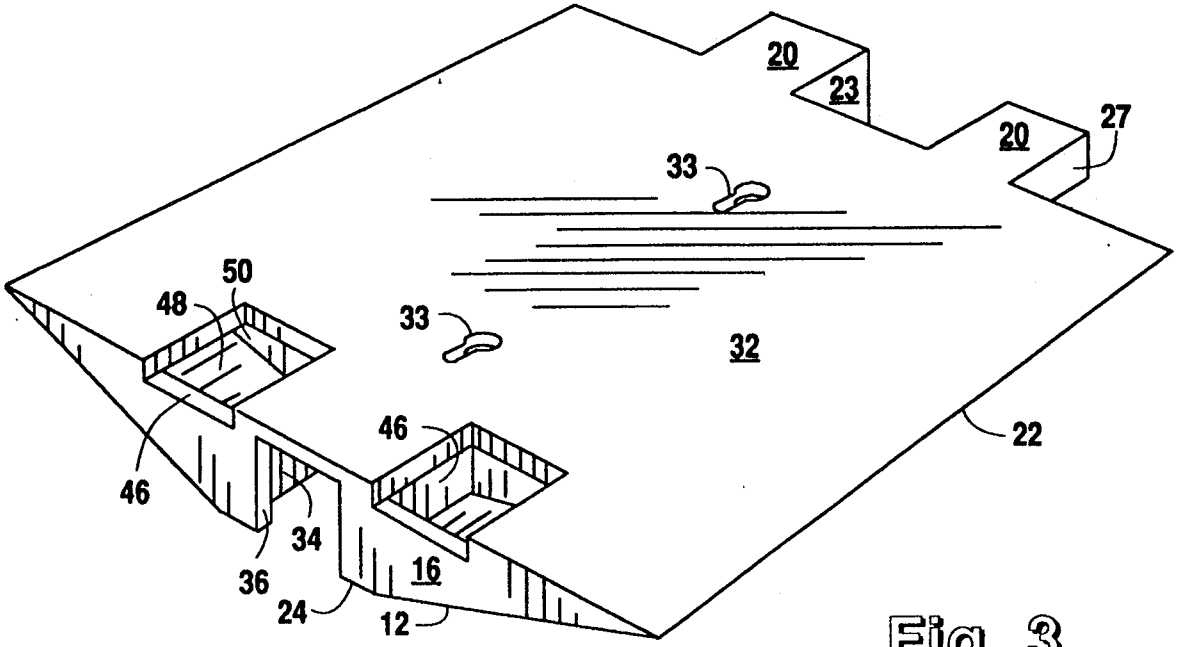
FIG. 3 is a perspective view of the bottom of the ramp unit of FIG. 1.

In the preferred embodiment shown in FIG. 4, the top surface 21 of the upward projection 23 of the projecting member 20 abuts the underside 48 of the ramp plate 12 of the adjacent ramp unit 10, thereby supporting the ramp plate 12 and helping to interlock the two ramp units 10 This cross-section shown in FIG. 4 is taken across the location of the ramp unit 10 of the projecting member 20. As is clear from FIGS. 1 to 3, the preferred embodiment of the present invention is provided with two projecting members 20 on each end 16 of the ramp unit 10 and two openings 46 to receive the projecting members 20 on the other interlocking end 16.

The safety ramp units 10 have projecting members 20 formed in the preferred embodiment so that when the units 10 are interlocked in a chain there is enough play between the projecting members 20 and the openings 46 in adjacent ramp units 10 to allow the chain to bend from side to side to form curves. In one preferred embodiment, the projecting members 20 are dimensioned so that the bearing 25 and retaining 49 surfaces of the ramp unit 10 and projecting member 20, respectively, do not fit closely against the gusset 30 and inside 50 surfaces, respectively, of the ramp unit 10. Embodiments in which other dimensions of the projecting members 20 are varied to accomplish the same purpose are also intended to fall within the scope of the present invention. These embodiments can be useful where a hose or other utility conduit is bent or the surface upon which such a conduit rests is not flat.

In an alternative embodiment, the projecting members 20 are formed to eliminate any play between said units 10 when interlocked. In one embodiment, the projecting members 20 are formed in all dimensions to fit closely to the dimensions of the openings 46 of the adjacent ramp units 10. Restricting the play between the ramp units 10 can also be accomplished, for example, by angling or forming the ends 16 of the ramp units 10 in a diamond, curved, or pointed shape or by having the projecting members 20 extend from the ramp units 10 at an angle and forming the corresponding openings 46 accordingly, thereby creating angular force vectors between the interlocked ramp units 10. All such shapes are intended to fall within the meaning of a ramp unit 10 that is "substantially rectangular."

The preferred embodiment of the ramp unit 10 is provided with a plurality of gussets 30 which extend upwardly from the bottom 32 of the ramp unit 10 to the underside 48 of the ramp plates 12. These gussets 30 provide support to the ramp plates 12 and are spaced to fit closely up against the bearing surface 25 of a projecting member 20 that is inserted through the opening 46 in the ends 16 of each ramp unit 10.

Furthermore, the ramp plates 12 are provided with a textured surface 26 in one preferred embodiment to provide traction between the ramp units 10 and traffic. This texture may be, for example, like Q decking textures.

In an alternative embodiment of the invention, the substantially rectangular ramps units 10 are formed with an additional end 16, e.g., the conduit channel 14 is branched, so that the single ramp unit is interlocked with three or more ramp units 10. A chain of ramp units can therefore be formed that is branched, instead of just linear. The additional end 16 is formed with either projecting members 20 or openings 46 for receiving projecting members 20.

The bottom 32 of ramp unit 10 in the preferred embodiment is enclosed and is provided with one or more holes 33 for receiving a means (not shown) for securing the ramp unit 10 to the surface upon which it rests. For example, spikes may be driven through the holes 33 in the bottom 32 of the ramp unit 10. In one embodiment, the holes 33 are provided with large and small portions. The spikes after being driven into the ground are inserted into the larger portion of the hole 33. The whole ramp unit is then slid so that the spike moves into the narrow part of the hole 33. The ramp unit is then held down by the spike head. Other means of attaching the ramp units to the ground can also be used and are well-known to those skilled in the art. The holes 33 serve the additional purpose of allowing any water which finds its way into the channel conduit 14 to drain out of the bottom of the channel.

Some surfaces upon which a safety ramp is used may be covered with loose gravel or have some other characteristic that would cause the safety ramp units 10 to slide around. Therefore, in one embodiment of the ramp unit 10, the bottom 32 is not enclosed, except in the area where the conduit channel 14 is located. The combination of a bottom surface 32 which is substantially open and the construction of the ramp unit 10 from resilient material (see below), also has the advantage of allowing the ramp unit 10 to be able to function for its intended purpose on an irregular surface such as an unpaved road or on a road that is better characterized as being two spaced, parallel ruts.

The ramp units 10 of the present invention, as stated above, are substantially rectangular. Substantially rectangular as defined herein is intended to be broadly defined to include shapes whose cross-sectional areas are rectangles, parallelograms, trapezoids, squares, hexagons, shapes including arcuate sides, and any other shape recognized as functionally equivalent and suitable for the safety ramp of the present invention by those skilled in the art having the benefit of the teachings herein.

The safety ramp of the present invention may be made of any material suitable for bearing weight and may be varied depending on the type of traffic that will be crossing the conduit. For vehicular traffic, materials such as plastics, recycled copolymers, rubbers and concrete may be appropriate. Suitable plastics would include polyethylenes, polypropylene, nylon, acetal, polycarbonate, polyester, certain acrylics and other plastics with good tensile, compressive, and high impact strength, including reinforced plastics. In a preferred embodiment, pieces of shredded automobile tires are cast into the matrix of the material comprising the ramp unit 10. Inclusion of this material increases the weight and resilience of the ramp 10.

The method of protecting a hose or other utility conduit from damage caused by traffic involves several steps. First, a plurality of substantially rectangular ramp units are interlocked by inserting a member 20 projecting outwardly and upwardly from one end 16 of each respective ramp unit 10 into an opening 46 formed in the other end 16 of an adjacent ramp unit 10 to engage the inside surface 50 of the end 16 of the adjacent ramp unit 10 with the retaining surface 49 of member 20. In the preferred method, the top surface 21 of the upward projection 23 of the projecting member 20 abuts the underside 48 of the ramp plate 12 of the adjacent ramp unit 10, thereby supporting the ramp plate 12 and helping to interlock the two ramp units 10. Furthermore, the bearing surface 25 of the projecting member 20 fits up against a gusset 30 for further support. Next, the hose or utility conduit to be protected is placed into a conduit channel 14 formed in and running from end 16 to end 16 of each respective ramp unit 10, thereby forming an elongate channel 14 the length of the interlooked chain of ramp units 10 for receiving the hose or utility conduit therein. Then, the conduit channel 14 of each respective interlocked ramp unit 10 is closed with a cover 18, the top surface of the cover 18 being substantially flush with the maximum height of the ramp unit 10, which is at its horizontal plane 24.

In the preferred method, a means is formed in the walls 34 of the conduit channel 14 of each ramp unit 10 to provide a supporting surface for the channel cover 18. For instance, the channel cover 18 may be placed upon shelves 40 running the length of the walls 34 of the conduit channel 14.

One preferred method involves using a conduit channel 14 and channel cover 18 that are formed in a manner that provides resistance to relative movement between them. The shelf 40 mentioned above is one means for resisting movement. Other such means are corner posts 36 in the conduit channels 14, legs 38 extending downwardly from the channel cover 18, and flanges 42 running the length of the edges 44 of the channel cover 18.

Another alternative method of the present invention involves interlocking the safety ramp units 10 in branched patterns using ramp units 10 wherein the conduit channel 14 and channel cover 18 are branched for the purpose of connecting a chain of ramp units 10 that extends in more than two directions. Thus, hoses, pipes, and other utility conduits that are either linear or branched may be protected by this invention.

Those skilled in the art upon reading the above detailed description of the present invention will appreciate that many modifications of the apparatus and method described above can be made without departing from the spirit of the invention. All such modifications which fall within the scope of the appended claims are intended to be covered thereby.

What is claimed is:

1. A safety ramp for protecting a hose or utility conduit which comprises:

a plurality of substantially rectangular ramp units, each of said ramp units having opposed ramp plates forming the sides thereof said ramp plates being inclined from the outer edge of the ramp unit upwardly to the maximum height of the ramp unit;

a conduit channel formed in each of said ramp units between the inclined ramp plates and running from end to end of said ramp unit;

a channel cover comprising a horizontal plate having a top surface which is substantially flush with the top surface of said ramp unit and a vertically extending plate adapted to extend downwardly into the conduit channel of each of said ramp units for providing a protective covering for the conduit channel; and a member projecting outwardly and upwardly from the end of each of said ramp units and adapted for receiving through an opening formed in the end of an adjacent ramp unit for engaging the inside surface of the end of the adjacent ramp unit for interlocking adjacent ramp units to form a chain of ramp units having a continuous conduit channel therethrough for protecting a hose or utility conduit received therein.

2. The safety ramp of claim 1 wherein the conduit channel is formed in said ramp unit between the inclined ramp plates at the maximum height of the ramp unit and said channel cover forms a substantially horizontal plane across the conduit channel.

3. The safety ramp of claim 1 wherein the ramp plates of each of said ramp units are supported by a plurality of gussets extending upwardly from the bottom of the ramp unit to the underside of the ramp plates.

4. The safety ramp of claim 1 wherein the conduit channel of each of said ramp units is provided with corner posts formed in the walls of the conduit channel near the ends thereof.

5. The safety ramp of claim 4 wherein the channel cover rests on said corner posts when covering the conduit channel.

6. The safety ramp of claim 1 wherein the channel cover of each of said ramp units is provided with said vertically extending plate extending downwardly therefrom dimensioned so as to approximate the shape of the conduit channel for resisting relative movement between the ramp unit and said channel cover.

7. The safety ramp of claim 6 wherein said movement resisting means rests on the bottom of said conduit channel to support said channel cover.

8. The safety ramp of claim 1 wherein the walls of the conduit channel of each of said ramp units is provided with for supporting said channel cover.

9. The safety ramp of claim 8 wherein the channel cover of each of said ramp units is provided with said vertically extending plate extending downwardly therefrom and dimensioned so as to approximate the shape of the conduit channel for resisting relative movement between said ramp unit and said channel cover.

10. The safety ramp of claim 9 wherein said movement resisting means is formed inwardly from the sides of said channel cover to form flanges running the length of the sides of said channel cover for resting on the shelves formed in the walls of the conduit channel.

11. The safety ramp of claim 1 wherein the upward projection of the projecting member of each of said ramp units is dimensioned so as to abut the underside of the ramp plate of the adjacent ramp unit for supporting the ramp plate, the weight of the ramp plate supported by the upward projection helping to interlock the adjacent ramp unit said ramp unit.

12. The safety ramp of claim 1 wherein the conduit channel and channel cover are branched for the purpose of connecting a chain of ramp units that extends in more than two directions.

13. The safety ramp of claim 1 wherein the bottom of the ramp unit is enclosed.

14. The safety ramp of claim 1 wherein the bottom of the ramp unit is not enclosed, except that portion where the conduit channel is located.

15. The safety ramp of claim 1 wherein the bottom of the ramp unit is provided with means for securing the ramp unit to a surface upon which the ramp unit rests.

16. The safety ramp of claim 1 wherein the ramp plates are provided with a textured surface.

17. A method of protecting a hose or utility conduit laid across a traffic area from damage caused by the crossing of traffic over the hose or utility conduit comprising the steps of:

interlocking a plurality of substantially rectangular ramp units by inserting a member projecting outwardly and upwardly from one end of each respective ramp unit into an opening formed in the other end of an adjacent ramp unit to engage the inside surface of the end of the adjacent ramp unit;

placing the hose or utility conduit to be protected into a conduit channel formed in and running from end to end of each respective ramp unit, thereby forming an elongate channel the length of the interlocked chain of ramp units for receiving the hose or utility conduit therein; and closing the conduit channel of each respective interlocked ramp unit with a cover, comprising a horizontal plate and a vertically extending plate adapted to extend down onto the conduit channel the top surface of the horizontal plate of the cover being substantially flush with the maximum height of a ramp formed in each respective ramp unit on both sides of the conduit channel.

18. The method of claim 16 additionally comprising resisting relative movement between each ramp unit and the respective channel cover.

19. The method of claim 16 additionally comprising supporting the channel cover of each respective ramp unit with means formed in the walls of the conduit channel thereof on which the channel cover rests.

* * * * *